US009678446B2

(12) United States Patent
Ishida et al.

(10) Patent No.: US 9,678,446 B2
(45) Date of Patent: Jun. 13, 2017

(54) ELECTROPHOTOGRAPHIC PHOTOCONDUCTOR, IMAGE FORMING APPARATUS, AND PROCESS CARTRIDGE

(71) Applicants: Toshihiro Ishida, Shizuoka (JP); Eiji Kurimoto, Shizuoka (JP); Tetsuro Suzuki, Shizuoka (JP); Tomoharu Asano, Kanagawa (JP); Daisuke Nii, Shizuoka (JP)

(72) Inventors: Toshihiro Ishida, Shizuoka (JP); Eiji Kurimoto, Shizuoka (JP); Tetsuro Suzuki, Shizuoka (JP); Tomoharu Asano, Kanagawa (JP); Daisuke Nii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/945,498

(22) Filed: Nov. 19, 2015

(65) Prior Publication Data

US 2016/0139517 A1 May 19, 2016

(30) Foreign Application Priority Data

Nov. 19, 2014 (JP) ..... 2014-234651

(51) Int. Cl.
*G03G 5/00* (2006.01)
*G03G 5/14* (2006.01)

(52) U.S. Cl.
CPC ..... *G03G 5/144* (2013.01)

(58) Field of Classification Search
CPC ..... G03G 5/144
USPC ..... 430/60, 64
See application file for complete search history.

(56) References Cited

U.S. PATENT DOCUMENTS

| | | | | |
|---|---|---|---|---|
| 7,659,044 | B2 | 2/2010 | Li et al. | |
| 9,291,924 | B2 | 3/2016 | Kurimoto et al. | |
| 2008/0032221 | A1* | 2/2008 | Lin | G03G 5/142 430/58.65 |
| 2015/0309430 | A1 | 10/2015 | Nii et al. | |

FOREIGN PATENT DOCUMENTS

| | | | |
|---|---|---|---|
| JP | 2003-84472 | A | 3/2003 |
| JP | 2003-91086 | A | 3/2003 |
| JP | 2003-98705 | A | 4/2003 |
| JP | 2007-47467 | A | 2/2007 |
| JP | 5358161 | B2 | 12/2013 |

* cited by examiner

*Primary Examiner* — Mark A Chapman
(74) *Attorney, Agent, or Firm* — Oblon, McClelland, Maier & Neustadt, L.L.P.

(57) ABSTRACT

A electrophotographic photoconductor is provided. The electrophotographic photoconductor includes a conductive support, an undercoat layer overlying the conductive support, and a photosensitive layer overlying the undercoat layer. The undercoat layer includes a metal oxide particle, binder resin, and a compound having a urea group.

14 Claims, 3 Drawing Sheets

ELECTROPHOTOGRAPHIC PHOTOCONDUCTOR, IMAGE FORMING APPARATUS, AND PROCESS CARTRIDGE

CROSS-REFERENCE TO RELATED APPLICATIONS

This patent application is based on and claims priority pursuant to 35 U.S.C. §119(a) to Japanese Patent Application Nos. 2014-234651, filed on Nov. 19, 2014, respectively, in the Japan Patent Office, the entire disclosure of each of which is hereby incorporated by reference herein.

BACKGROUND

Technical Field

The present disclosure relates to an electrophotographic photoconductor, and an image forming apparatus and a process cartridge.

Description of the Related Art

In an image forming method performed by an image forming apparatus, an image is formed by exposing an electrophotographic photoconductor (hereinafter may be referred to as "photoconductor") to the processes of charging, irradiation, developing, transfer, etc. Nowadays, organic photoconductors (OPC) that use organic materials are widely used as the electrophotographic photoconductor in terms of their flexibility, thermal stability, and film formation property.

The photoconductor is required to have much higher durability and stability in accordance with the rapid progress of image forming apparatus technologies in terms of colorization, speeding up, and higher definition. An abrasion resistance of the photoconductor was improved drastically by improving a surface layer such as a protective layer. In contrast, an electrical durability and a chemical durability comes to be demanded to each layer constituting the photoconductor such as a photosensitive layer, an intermediate layer and an undercoat layer.

Through repeated exposure to the charging and neutralization processes in electrophotography, the organic materials contained in the photoconductor will gradually denature. As a result, charge trapping or charge property change will occur in the layers. In this way, an electric characteristic of the photoconductor deteriorates and an electrical stability in the long usage cannot be maintained. Deterioration in charge property largely affects the quality of the output images. For example, decrease in image density, background fog, residual image, and/or non-homogeneous image after continuous printing may be caused. Possible reasons of these problems are a characteristic of the undercoat layer of the photoconductor. Future improvement of the undercoat layer is necessary for a durability and a high stabilization of the photoconductor.

Generally, the undercoat layer is provided for the purpose of following three functions:

a function of leak resistance by covering surface of the support (hereinafter "leak resistant function"), a function of preventing charge injection from the support into the photosensitive layer (hereinafter "charge injection prevention function") and a function of transporting charges generated in the photosensitive layer to the support (hereinafter "charge transport function"). Improving these functions are demanded.

The undercoat layer comprising the titanium oxide particle is proposed. However, leak resistant function by covering surface of the support is insufficient because a thickness of the undercoat layer is range of 1 μm to several μm. The content of the titanium oxide particle is approximately 80% of the undercoat layer, it is difficult to maintain the dispersibility of the titanium oxide particle in the undercoat layer because there is much content of the titanium oxide particle. So, the leak point caused by fine cracks of the undercoat layer occurs. As a result, the abnormal image by the background fog occurs after a long period of use. In addition, a secondary undercoat layer overlying the undercoat layer is proposed in order to provide leak resistant function. However, the photoconductor function cannot be maintained enough because electric charge accumulations increase with the increase of the layer interface. Furthermore, the undercoat layer comprising tin oxide particles or zinc oxide particles is proposed. Thickness of the undercoat layer is several 10 μm, and the undercoat layer can make into a thick film while controlling volume resistance. However, it is difficult for the undercoat layer to satisfy all requesting properties such as, improving of leak resistant function by thickening the undercoat layer, and electric characteristic stabilization.

SUMMARY

In accordance with some embodiments of the present invention, an electrophotographic photoconductor is provided. The electrophotographic photoconductor includes a conductive support, an undercoat layer overlying the conductive support, and a photosensitive layer overlying the undercoat layer. The undercoat layer includes a metal oxide particle, a binder resin, and a compound having a urea group.

In accordance with some embodiments of the present invention, an image forming apparatus is provided. The image forming apparatus includes the above electrophotographic photoconductor, a charger, an irradiator, a developing device, and a transfer device. The charger charges a surface of the electrophotographic photoconductor. The irradiator irradiates the charged surface of the electrophotographic photoconductor with light to form an electrostatic latent image thereon. The developing device develops the electrostatic latent image into a visible image with toner. The transfer device transfers the visible image onto a recording medium.

In accordance with some embodiments of the present invention, a process cartridge detachably mountable on image forming apparatus is provided. The process cartridge includes the above electrophotographic photoconductor and at least one of the above charger, irradiator, developing device, and transfer device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
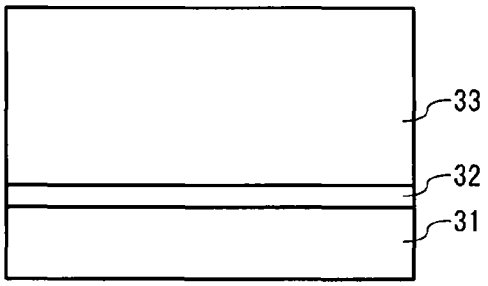
FIG. 1 is a schematic cross-sectional view of an electrophotographic photoconductor according to an embodiment of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. For the sake of simplicity, the same reference number will be given to identical constituent elements such as parts and materials having the same functions and redundant descriptions thereof omitted unless otherwise stated. Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

The photoconductor which comprise the undercoat layer satisfying all functions such as leak resistant function, charge injection prevention function, and charge transport function is not provided. Therefore, the photoconductor which can restrain residual image, the background fog and can get a stable electricity characteristic, after a long period of use, is not provided.

One object of the present invention is to provide an electrophotographic photoconductor which can get a stable electric characteristic and restrain background fog and residual image, even after a long period of use.

In accordance with some embodiments of the present invention, an electrophotographic photoconductor which get a stable electric characteristic and restrain background fog and residual image, even after a long period of use is provided.

Electrophotographic Photoconductor

The electrophotographic photoconductor according to an embodiment of the present invention includes at least a conductive support, an undercoat layer overlying the support, and a photosensitive layer overlying the undercoat layer, and optionally other layers, if necessary.

Undercoat Layer

Preferably, the undercoat layer covers completely the conductive support with a homogeneous film (i.e., leak resistant function), has a function (i.e., charge injection prevention function) that suppresses injection of unnecessary charges (i.e., charges having a polarity opposite to the charging polarity of the photoconductor) from the support into the photosensitive layer, and another function (i.e., charge transport function) that transports charges generated in the photosensitive layer which have the same polarity as the charging polarity of the photoconductor. In a photoconductor which is stable for an extended period of time, these properties will not change even after repeated exposure to electrostatic loads.

These characteristics can be satisfied by containing the metal oxide particle, the binder resin, and the compound having the urea group, in the undercoat layer. In accordance with some embodiments of the present invention, a reason why all the functions necessary for the undercoat layer are satisfied is not clear, but the following reason is thought about. The metal oxide particle is formed a good dispersion state because the compound having the urea group improve the affinity of the metal oxide particle with the binder resin. Accordingly, charge injection prevention function and charge transport function demanded to the undercoat layer are improved.

A Metal Oxide Particle

There is no specific limit to the metal oxide particle and a suitable metal oxide particle can be selected to a particular application. Specific examples of such metal oxide particle includes, but are not limited to, titanium oxide, tin oxide, zinc oxide, indium oxide, antimony oxide, and ITO. These can be used alone or in combination. The zinc oxide particles is more preferable because of a stable electric characteristic.

There is no specific limitation to the average primary particle diameter of the metal oxide particle. The metal oxide particle preferably has an average primary particle diameter of from 10 nm to 500 nm and more preferably from 20 nm to 200 nm. When the average primary particle diameter is less than 10 nm, it may be difficult to form the undercoat layer in good dispersion state of the metal oxide particle. When the average primary particle diameter is more than 500 nm, it may be difficult to maintain a superior electric characteristic of the undercoat layer. The average primary particle diameter of the zinc oxide particles can be determined by observing 100 randomly-selected particles in the undercoat layer with a transmission electron microscope (TEM), measuring the projected areas of the particles, calculating circle-equivalent diameters of the projected areas, calculating a volume average particle diameter from circle-equivalent diameters. The volume average particle is defined as the average primary particle diameter.

The content of the metal oxide particle in the undercoat layer is not limited to any particular method, and may be appropriately selected depending on the intended purpose. The content of the metal oxide particle in the undercoat layer is preferably of from 10% by mass to 80% by mass, and more preferably from 30% by mass to 60% by mass. When the content is less than 10% by mass, a good electricity characteristic may not be maintained because volume resistance of the undercoat layer becomes too high. When the content is more than 80% by mass, a good electricity characteristic may not be maintained because the leak point caused by fine cracks of the undercoat layer easily occurs.

Zinc Oxide Particles

A manufacturing method which can prepare the zinc oxide particles having average primary particle diameter of from 20 nm to 200 nm is preferable. The zinc oxide particles can be prepared by any known method. For example, the zinc oxide particles made by a dry method such as a French method or an American method, or made by a wet method such as a Germany method, can be used. The French method is a method wherein metallic zinc is heated, vaporized, oxidized and cooled to obtain the zinc oxide particles. The American method is a method wherein a reducing agent is added to a natural ore containing zinc, and zinc is vaporized, reduced and oxidized by air to obtain the zinc oxide particles. The Germany method is a method that involves neutralizing an aqueous solution of zinc sulfate or zinc chloride with a soda ash solution to produce zinc carbonate, and water-washing, drying, and burning the zinc carbonate. Another wet method is a method that involves producing zinc hydroxide, and water-washing, drying, and burning the zinc hydroxide. The zinc oxide particles grown up to several μm with about 1,000° C. is used for pottery use, and referred to as zinc flower. The zinc oxide manufactured by the wet method includes an alkali metal ion or a sulfuric acid ion originating from the manufacturing method. In addition, there is a method using thermolysis of oxalic acid zinc to get the zinc oxide of ultra-fine particles class (≤0.1 μm).

Compound Having Urea Group

Specific examples of the compound having a urea group include, but are not limited to, urea, 1-methyl urea, 1-ethyl urea, 1-propyl urea, 1-butyl urea, 1-pentyl urea, 1-hexyl urea, 1,1-dimethyl urea, 1,1-diethyl urea, 1,3-dimethyl urea, 1,3-diethyl urea, tetramethyl urea, tetraethyl urea, tetrabutyl urea, phenyl urea, 1,3-phenyl urea, o-tolyl urea, m-tolyl urea, p-tolyl urea, 1,3-diphenyl urea, 1,3-diethyl-1,3-diphenyl urea, N,N'-dimethyl-N,N'-diphenyl urea, benzyl urea, 1-[3-(trimethoxysilyl)propyl]urea, 1-[3-(triethoxysilyl)propyl]urea, 1-[3-(dimethoxysilyl methyl)propyl]urea, 1-[3-(dimethoxysilyl propyl)propyl]urea. These can be used alone or in combination. The compound having the urea group does not include urea resins.

Among these, examples of a compound of Formula (1) is preferable. The compound having a methoxysilyl or an ethoxysilyl group are more preferable. It is particularly effective to modify the surface of the metal oxide particle with 1-[3-(trimethoxysyril)propyl]urea and 1-[3-(triethoxysyril)propyl]urea, and to immobilize them on the surface of the metal oxide particle.

Formula (1)

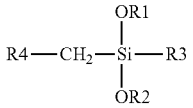

wherein R1 and R2 independently represent alkyl group having 1 to 2 carbon atoms, R3 represent alkyl group having 1 to 3 carbon atoms or alkoxy group having 1 to 2 carbon atoms, R4 represent structural formula having a urea group.

When the surface of the metal oxide particle is treated with a compound having an alkoxysilyl group and the urea group, and modified the surface of the metal oxide particle with the compound having the urea group, the affinity of the metal oxide particle with the binder resin and an effect of forming a good dispersion state are further improved. Accordingly, charge injection prevention function and charge transport function demanded to the undercoat layer can be further improved. A method of treatment of the metal oxide particle with a compound having the alkoxysilyl group and the urea group is not particularly limited and may be appropriately selected depending on the intended purpose. The surface treatment method includes, for example, a dry method and a wet method.

Dry Method

In the dry method, the compound having the urea group or an organic solvent solution thereof is dropped or sprayed into the zinc oxide particles being stirred with a large shearing force by a mixer, along with dried air or nitrogen gas in the case of the spraying. The dropping or spraying is preferably performed at a temperature equal to or less than the boiling point of the solvent. When the spraying is performed at a temperature above the boiling point of the solvent, the solvent will evaporate before a uniform stirring is achieved and the compound having the urea group locally get hard, which is not preferable in terms of uniform surface treatment. After the dropping or spraying, a burning can be performed at 100° C. or more. The burning can be performed at any temperature for any period of time so long as desired electrophotographic properties can be obtained.

Wet Method

In the wet method, for example, the zinc oxide particles are stirred and dispersed in a solvent with an ultrasonic disperser, sand mill, attritor, or ball mill, the compound having the urea group is added and stirred and dispersed therein, and the solvent is removed. The solvent is removed by means of filtering or distilling. After the solvent has been removed, a burning can be performed at 100° C. or more. The burning can be performed at any temperature for any period of time so long as desired electrophotographic properties can be obtained. In the wet method, it is possible to remove moisture from the zinc oxide particles before the surface treatment agent is added thereto. For example, moisture can be removed by stirring and heating the zinc oxide particles in a solvent used for the surface treatment, or by boiling the zinc oxide particles together with the solvent.

It can be confirmed that a surface of the metal oxide particle is modified by the compound having the urea group by using surface analytical method such as photoelectron spectroscopy (ESCA), Auger electron spectroscopy, time-of-flight secondary ion mass spectrometry (TOF-SIMS), Fourier transform infrared spectroscopy (FT-IR).

The content of the compound having the urea group is preferably from 0.3% by mass to 6% by mass relative to the metal oxide particle, more preferably from 1% by mass to 3% by mass relative to the metal oxide particle. When the content of the compound having the urea group is less than 0.3% by mass relative to the metal oxide particle, a characteristic may not be provided because a performance of the compound having the urea group is not sufficiently effective. When the content of the compound having the urea group exceeds 6% by mass relative to the metal oxide particle, enough characteristics may not be provided because an inhibition of a dispersion of the metal oxide particle causes.

Binder Resin

A binder resin is not particularly limited and may be appropriately selected depending on the intended purpose. The binder resin includes, for example, a thermoplastic resin and a thermosetting resin. These can be used alone or in combination. The binder resin of the undercoat layer preferably includes a resin having a high resistance to organic solvents, in view of the application of the photosensitive layer, to be described in detail later, to the undercoat layer. Specific examples of such a resin include, but are not limited to, a water-soluble resin such as polyvinyl alcohol, casein, and sodium polyacrylate; an alcohol-soluble resin such as copolymerized nylon and methoxymethylated nylon; and a curable resin which forms a three-dimensional network structure, such as polyurethane, melamine resin, phenol resin, alkyd-melamine resin, and epoxy resin.

Other Components

The undercoat layer may include other components for the purpose of improving electric property, environmental stability, and image quality. Specific examples of such components include, but are not limited to, an electron transport material, an electron transport pigment such as a condensed polycyclic pigment and an azo pigment, a silane coupling agent, a zirconium chelate compound, a titanium chelate compound, an aluminum chelate compound, a fluorenone compound, a titanium alkoxide compound, an organic titanium compound, to be described in detail later, and an antioxidant, a plasticizer, a lubricant, an ultraviolet ray absorber and a leveling agent. Two or more of these materials can be used in combination.

A method of dispersing the zinc oxide particles in the undercoat layer coating liquid is not limited to any particular method, and may be appropriately selected depending on the intended purpose. Specific examples of such devices include ball mills, sand mills, vibration mills, three-roll mills, attritors, pressure-type homogenizers, and ultrasonic dispersing devices, etc. A method of applying the undercoat layer coating liquid is not limited to any particular method, and is determined depending on the viscosity of the undercoat layer coating liquid, a desired average thickness of the undercoat layer, etc. Specific examples of the application method include, but are not limited to, a dipping method, a spray coating method, a bead coating method, and a ring coating method. The undercoat layer coating liquid having been applied can be heat-dried with an oven, etc., if necessary. The drying temperature is determined depending on the type of the solvent included in the undercoat layer coating liquid, and is preferably from 80° C. to 200° C. and more preferably from 100° C. to 150° C.

Average Thickness of the Undercoat Layer

The average thickness of the undercoat layer is determined depending on the desired electric properties or lifespan of the electrophotographic photoconductor, and is preferably from 3.5 μm to 30 μm, and more preferably from 5 μm to 30 μm. When the average thickness of the undercoat layer is too small, charges having a polarity opposite to the charging polarity of the electrophotographic photoconductor will be injected from the support to the photosensitive layer, causing defective image having background fog. When the average thickness of the undercoat layer is too large, the optical attenuation characteristic may deteriorate to cause residual potential increase, or repetitive stability may deteriorate. The thickness of the undercoat layer can be measured with an eddy current thickness meter, a feeler-type film thickness measuring instrument, scanning electron microscope and a transmission electron microscope, etc. An average thickness of the undercoat layer is determined by averaging the thickness value of randomly selected five points of the photoreceptor.

Photosensitive Layer

The photosensitive layer may be either a multi-layer photosensitive layer or a single-layer photosensitive layer.

Single-Layer Photosensitive Layer

The single-layer photosensitive layer has both a charge generation function and a charge transport function. The single-layer photosensitive layer includes at least a charge generation material, a charge transport material, and a binder resin, and optionally other components, if necessary.

Charge Generation Material

Specific examples of the charge generation material include, but are not limited to, those for use in the multi-layer photosensitive layer to be described later. The content of the charge generation material is preferably from 5 to 40 parts by mass based on 100 parts by mass of the binder resin.

Charge Transport Material

Specific examples of the charge transport material include, but are not limited to, those for use in the multi-layer photosensitive layer to be described later. The content of the charge transport material is preferably 190 parts by mass or less, more preferably from 50 to 150 parts by mass, based on 100 parts by mass of the binder resin.

Binder Resin

Specific examples of the binder resin include, but are not limited to, those for use in the multi-layer photosensitive layer to be described later.

Other Components

Specific examples of the other components include, but are not limited to, those for use in the multi-layer photosensitive layer to be described later, such as a low-molecular-weight charge transport material, a solvent, and an antioxidant, a plasticizer, a lubricant, an ultraviolet ray absorber and a leveling agent.

Method of Forming Single-Layer Photosensitive Layer

A method of forming the single-layer photosensitive layer may include, for example, dissolving or dispersing the charge generation material, charge transport material, a binder resin, and other components in a solvent (e.g., tetrahydrofuran, dioxane, dichloroethane, cyclohexane) with a disperser to prepare a coating liquid, and applying and drying the coating liquid. A method of applying the coating liquid may be, for example, a dipping method, a spray coating method, a bead coating method, or a ring coating method. The single-layer photosensitive layer may further include additives such as a plasticizer, a leveling agent, and an antioxidant, if necessary. The average thickness of the single-layer photosensitive layer is not limited to any particular method, and may be appropriately selected depending on the intended purpose. The average thickness of the single-layer photosensitive layer is preferably from 5 μm to 25 μm.

Multi-Layer Photosensitive Layer

In the multi-layer photosensitive layer, a charge generation function and a charge transport function are provided from independent layers. Accordingly, the multi-layer photosensitive layer has a charge generation layer and a charge transport layer. In the multi-layer photosensitive layer, the stacking sequence of the charge generation layer and charge transport layer is not limited. Generally, most charge generation materials are poor in chemical stability and cause deterioration in charge generation efficiency when exposed to an acid gas, such as a discharge product generated around a charger in an electrophotographic apparatus. Therefore, it is preferable that the charge transport layer is overlaid on the charge generation layer.

Charge Generation Layer

The charge generation layer includes at least a charge generation material and a binder resin, and optionally other components such as an antioxidant to be described later, if necessary.

Charge Generation Material

Specific examples of the charge generation material include, but are not limited to, an inorganic material and an organic material.

Inorganic Material

Specific examples of the inorganic material include, but are not limited to, crystalline selenium, amorphous selenium, selenium-tellurium compounds, selenium-tellurium-halogen compounds, selenium-arsenic compounds, and amorphous silicon (e.g., those in which dangling bonds are terminated with hydrogen atom, halogen atom, etc.; or doped with boron atom, phosphor atom, etc.).

Organic Material

Specific examples of the organic material include, but are not limited to, phthalocyanine pigments such as metal phthalocyanine and metal-free phthalocyanine; azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone or polycyclic quinone pigments, quinonimine pigments, diphenylmethane and triphenylmethane pigments, benzoquinone and naphthoquinone pigments, cyanine and azomethine pigments, indigoid pigments, and bisbenzimidazole pigments. Two or more of these materials can be used in combination.

Binder Resin

Specific examples of the binder resin include, but are not limited to, polyamide resin, polyurethane resin, epoxy resin, polyketone resin, polycarbonate resin, silicone resin, acrylic resin, polyvinyl butyral resin, polyvinyl formal resin, polyvinyl ketone resin, polystyrene resin, poly-N-vinylcarbazole resin, and polyacrylamide resin. Two or more of these resins can be used in combination. Specific examples of the binder resin further include charge transport polymers having a charge transport function, such as polymers (e.g., polycarbonate, polyester, polyurethane, polyether, polysiloxane) having an aryl skeleton, a benzidine skeleton, a hydrazone skeleton, a carbazole skeleton, a stilbene skeleton, a pyrazoline skeleton, etc.; and polymers having a polysilane skeleton.

Other Components

Specific examples of the other components include, but are not limited to, a low-molecular-weight charge transport material, a solvent, to be described later, and an antioxidant, a plasticizer, a lubricant, an ultraviolet ray absorber and a leveling agent. The content of the other components is preferably form 0.01% to 10% by mass based on total mass of the layer.

Low-Molecular-Weight Charge Transport Material

Specific examples of the low-molecular-weight charge transport material include, but are not limited to, an electron transport material and a hole transport material. Specific examples of the electron transport material include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. Two or more of these materials can be used in combination. Specific examples of the hole transport material include, but are not limited to, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. Two or more of these materials can be used in combination.

Solvent

Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate. Two or more of these solvents can be used in combination.

Method of Forming Charge Generation Layer

A method of forming the charge generation layer may include, for example, dissolving or dispersing the charge generation material and the binder resin in the other component, such as the solvent, to prepare a coating liquid, applying the coating liquid on the conductive support, and drying the coating liquid. The coating liquid can be applied by, for example, a casting method. The average thickness of the charge generation layer is preferably from 0.01 to 5 μm, and more preferably from 0.05 to 2 μm.

Charge Transport Layer

The charge transport layer has a function of retaining charges and another function of transporting charges generated in the charge generation layer upon light exposure to make them bind the charges retained in the charge transport layer. In order to retain charges, the charge transport layer is required to have a high electric resistance. Additionally, in order to achieve a high surface potential with the retaining charges, the charge transport layer is required to have a small permittivity and good charge mobility. The charge transport layer includes at least a charge transport material and a binder resin, and optionally other components, if necessary.

Charge Transport Material

Specific examples of the charge transport material include, but are not limited to, an electron transport material, a hole transport material, and a polymeric charge transport material. The content of the charge transport material is preferably from 20% to 90% by mass, more preferably from 30% to 70% by mass, based on total mass of the charge transport layer. When the content is less than 20% by mass, the charge mobility in the charge transport layer is so small that a desired optical attenuation characteristic may not be obtained. When the content exceeds 90% by mass, the charge transport layer may become excessively worn by various hazards to which the photoconductor has been exposed in an image forming process. When the content of the charge transport material in the charge transport layer is within the above-described range, desired optical attenuation characteristics can be obtained with a smaller amount of wear of the photoconductor.

Electron Transport Material

Specific examples of the electron transport material (electron-accepting material) include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. Two or more of these materials can be used in combination.

Hole Transport Material

Specific examples of the hole transport material (electron-donating material) include, but are not limited to, oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Two or more of these materials can be used in combination.

Polymeric Charge Transport Material

The polymeric charge transport material has both a function of a binder resin and a function of charge transport material. Specific examples of the polymeric charge transport material include, but are not limited to, polymers having a carbazole ring, polymers having a hydrazone structure, polysilylene polymers, polymers having a triarylamine structure (e.g., described in JP-3852812-B and JP-3990499-B), and polymers having an electron-donating group. Two or more of these materials can be used in combination. Below-described binder resins can also be used in combination for improving abrasion resistance and film formation property. The content of the polymeric charge transport material is preferably from 40% to 90% by mass, more preferably from 50% to 80% by mass, based on total mass of the charge transport layer, when the polymeric charge transport material and the binder resin are used in combination.

Binder Resin

Specific examples of the binder resin include, but are not limited to, polycarbonate resin, polyester resin, methacrylic resin, acrylic resin, polyethylene resin, polyvinyl chloride resin, polyvinyl acetate resin, polystyrene resin, phenol resin, epoxy resin, polyurethane resin, polyvinylidene chloride resin, alkyd resin, silicone resin, polyvinyl carbazole resin, polyvinyl butyral resin, polyvinyl formal resin, polyacrylate resin, polyacrylamide resin, and phenoxy resin. Two or more of these resins can be used in combination. The charge transport layer may further include a copolymer of a cross-linkable binder resin with a cross-linkable charge transport material.

Other Components

Specific examples of the other components include, but are not limited to, a solvent, to be described later, and an antioxidant, a plasticizer, a lubricant, an ultraviolet ray absorber and a leveling agent. The content of the other components is preferably form 0.01% to 10% by mass based on total mass of the layer.

Solvent

Specific examples of the solvent include, but are not limited to, those usable for the charge generation layer. In particular, those capable of well dissolving the charge transport material and the binder resin are preferable. Two or more of such solvents can be used in combination.

Method of Forming Charge Transport Layer

A method of forming the charge transport layer may include, for example, dissolving or dispersing the charge transport material and the binder resin in the other component, such as the solvent, to prepare a coating liquid, applying the coating liquid on the charge generation layer, and heating or drying the coating liquid. A method of applying the charge transport layer coating liquid is not limited to any particular method, and is determined depending on the viscosity of the coating liquid, a desired average thickness of the charge transport layer, etc. Specific examples of the application method include, but are not limited to, a dipping method, a spray coating method, a bead coating method, and a ring coating method.

In view of electrophotographic properties and film viscosity, the solvent should be removed from the charge transport layer by means of heating. The heating may be performed by, for example, heating the charge transport layer from the coated surface side or the conductive support side with heat energy such as a gas (e.g., the air, nitrogen), a vapor, a heat medium, infrared ray, and electromagnetic wave. The heating temperature is preferably from 100° C. to 170° C. When the heating temperature is less than 100° C., the solvent cannot be completely removed from the layer, causing deterioration in electrophotographic properties and abrasion durability. When the heating temperature exceeds 170° C., orange-peel-like defects or cracks may appear on the surface, and the layer may detach from adjacent layers. Moreover, in a case in which volatile components in the photosensitive layer are atomized, desired electric properties cannot be obtained.

The thickness of the charge transport layer is preferably at most 50 μm, more preferably at most 45 μm, so that the resultant photoreceptor can form high resolution images while having high responsiveness. The lower limit of the thickness changes depending on the conditions (particularly charge potential) of the system for which the photoreceptor is used, but is preferably at least 5 μm.

Other Layers

Specific examples of the other layers include, but are not limited to, a protective layer, an intermediate layer and a secondary undercoat layer.

Protective Layer

In accordance with some embodiments of the present invention, the electrophotographic photoconductor may have a protective layer (hereinafter may be referred to as "surface layer") overlying the photosensitive layer, for improvement of durability of the electrophotographic photoconductor or improvement of another function. The protective layer includes at least a binder resin and a filler, and optionally other components, if necessary.

Binder Resin

Specific examples of the binder resin include, but are not limited to, AS resin, ABS resin, ACS resin, olefin-vinyl monomer copolymer, chlorinated polyether resin, aryl resin, phenol resin, polyacetal resin, polyamide resin, polyamide-imide resin, polyacrylate resin, polyarylsulfone resin, polybutylene resin, polybutylene terephthalate resin, polycarbonate resin, polyethersulfone resin, polyethylene resin, polyethylene terephthalate resin, polyimide resin, acrylic resin, polymethylpentene resin, polypropylene resin, polyphenylene oxide resin, polysulfone resin, polyurethane resin, polyvinyl chloride resin, polyvinylidene chloride resin, and epoxy resin. Two or more of these materials can be used in combination. Among these materials, polycarbonate resin and polyacrylate resin are preferable in view of filler dispersibility, residual potential, and coated film defect.

Filler

Specific examples of the filler include, but are not limited to, a metal oxide particle.

Specific examples of such metal oxide particle includes, but are not limited to, aluminum oxide, zinc oxide, titanium oxide, tin oxide, antimony oxide, indium oxide, bismuth oxide, tin-containing indium oxide, antimony-containing tin oxide, tantalum-containing tin oxide and antimony-containing zirconium oxide. These can be used alone or in combination.

Specific examples of usable methods of forming the protective layer include, but are not limited to, those usable for methods of forming the photosensitive layer, such as a dipping method, a spray coating method, a bead coating method, a nozzle coating method, a spinner coating method, or a ring coating method. Specific examples of usable solvents for the protective layer coating liquid include, but are not limited to, those usable for the charge transport layer coating liquid, such as tetrahydrofuran, dioxane, toluene, dichloromethane, monochlorobenzene, dichloroethane, cyclohexanone, methyl ethyl ketone, and acetone. At the time of dispersing the filler or the binder resin in the coating liquid, a high-viscosity solvent is preferred. At the time of applying the coating liquid, a high-volatility solvent is preferred. If no solvent satisfies the above preferences, two or more types of solvents having different properties can be used in combination, which may have great effect on filler dispersibility and residual potential.

Further adding the charge transport material used for the charge transport layer to the protective layer is advantageous for reducing residual potential and improving image quality. The thickness of the protective layer is preferably from 1 μm to 5 μm in terms of abrasion resistance.

Intermediate Layer

The intermediate layer can be provided between the charge transport layer and the protective layer, for the purpose of suppressing charge transport layer components being mixed into the protective layer or improving adhesiveness between the two layers. The intermediate layer includes at least a binder resin, and optionally other components such as, to be described later, an antioxidant, if necessary. Preferably, the intermediate layer is insoluble or poorly-soluble in the protective layer coating liquid. Specific examples of the binder resin in the intermediate layer include, but are not limited to, polyamide, alcohol-soluble nylon, polyvinyl butyral, and polyvinyl alcohol. The intermediate layer can be formed in the same manner as the photosensitive layer is formed. The thickness of the intermediate layer is preferably from 0.05 μm to 2 μm.

Secondary Undercoat Layer

The secondary undercoat layer can be provided between the conductive support and the undercoat layer, or between the undercoat layer and the photosensitive layer. Specific examples of the binder resin in the secondary undercoat layer include, but are not limited to, polyamide, alcohol-soluble nylon, water-soluble polyvinyl butyral, polyvinyl butyral and polyvinyl alcohol. There is no specific limit to a method of forming the secondary undercoat layer and a suitable method or solvent can be selected to a particular application. The thickness of the secondary undercoat layer is preferably from 0.05 μm to 2 μm.

In accordance with some embodiments of the present invention, for the purpose of preventing sensitivity decrease and residual potential increase, charge generation layer, charge transport layer, undercoat layer, protective layer, and/or secondary undercoat layer may include an antioxidant, a plasticizer, a lubricant, an ultraviolet ray absorber, a leveling agent, etc., if necessary.

Specific examples of the antioxidant include phenolic compounds, paraphenylenediamine compounds, hydroquinone compounds, organic sulfur compounds, and organic phosphorous compounds, but are not limited thereto.

Specific examples of the plasticizer include, but are not limited to, dibutyl phthalate and dioctyl phthalate, which are general plasticizer for resins.

Specific examples of the lubricant include hydrocarbon compounds, fatty acid based compounds, fatty acid amide compounds, ester compounds, alcohol compounds, and metal soaps, natural waxes, but are not limited thereto. These can be used alone or in combination.

Specific examples of the ultraviolet absorbent include benzophenone compounds, salicylate compounds, benzotriazole compounds, cyanoacrylate compounds, quenchers (such as metal complexes), and hindered amines (HALS (hindered amine light stabilizer)), but are not limited thereto. These can be used alone or in combination.

Specific examples of the leveling agent include, but are not limited to, silicone oils such as dimethyl silicone oil and methyl phenyl silicone oil; and polymers and oligomers having a perfluoroalkyl side chain. These can be used alone or in combination.

The conductive support is not limited to any particular material so long as it is a conductive body having a volume resistivity of $1\times10^{10}$ Ω·cm or less. For example, endless belts (e.g., an endless nickel belt, an endless stainless-steel belt) disclosed in JP-S52-36016-B can be used as the support. The conductive support can be formed by, for example, covering a support body (e.g., a plastic film, a plastic cylinder, a paper sheet) with a metal (e.g., aluminum, nickel, chromium, nichrome, copper, gold, silver, platinum) or a metal oxide (e.g., tin oxide, and indium oxide) by means of vapor deposition or sputtering; or subjecting a plate of a metal (e.g., aluminum, aluminum alloy, nickel, stainless steel) to an extruding or drawing process and then subjecting the resulting tube to a surface treatment (e.g., cutting, super finishing, polishing).

The electrophotographic photoconductor may have a conductive layer overlying the conductive support. The conductive layer can be formed by, for example, applying a coating liquid, obtained by dispersing or dissolving a conductive powder and a binder resin in a solvent, to the conductive support; or using a heat-shrinkable tube which is dispersing a conductive powder in a material such as polyvinyl chloride, polypropylene, polyester, polystyrene, polyvinylidene chloride, polyethylene, chlorinated rubber, and TEFLON (trademark).

Specific examples of the conductive powder include, but are not limited to, carbon particles such as carbon black and acetylene black;

powders of metals such as aluminum, nickel, iron, nichrome, copper, zinc, and silver;

and powders of metal oxides such as conductive tin oxide and ITO.

Specific examples of the binder resin for use in the conductive layer include, but are not limited to, thermoplastic, thermosetting, and photo-curable resins, such as polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyarylate resin, phenoxy resin, polycarbonate resin, cellulose acetate resin, ethyl cellulose resin, polyvinyl butyral resin, polyvinyl formal resin, polyvinyl toluene resin, poly-N-vinylcarbazole, acrylic resin, silicone resin, epoxy resin, melamine resin, urethane resin, phenol resin, and alkyd resin. Two or more of these resins can be used in combination. Specific examples of the solvent for use in forming the conductive layer include, but are not limited to, tetrahydrofuran, dichloromethane, methyl ethyl ketone, and toluene.

Electrophotographic Photoconductor

First Embodiment

FIG. 1 is a schematic cross-sectional view of an electrophotographic photoconductor according to an embodiment of the present invention. The electrophotographic photoconductor illustrated in FIG. 1 has a single-layer photosensitive layer. This electrophotographic photoconductor includes, from the innermost side thereof, a conductive support 31, an undercoat layer 32, and a single-layer photosensitive layer 33.

Second Embodiment

Figure 2:
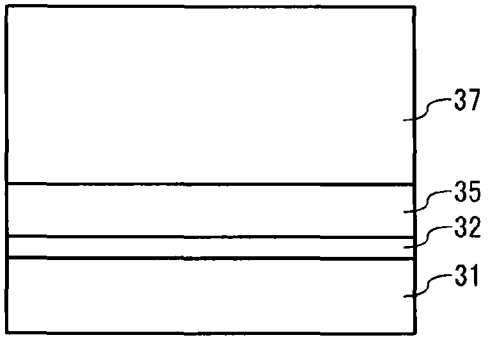
FIG. 2 is a schematic cross-sectional view of an electrophotographic photoconductor according to another embodiment of the present invention.

FIG. 2 is a schematic cross-sectional view of an electrophotographic photoconductor according to another embodiment of the present invention. The electrophotographic photoconductor illustrated in FIG. 2 has a multi-layer photosensitive layer. This electrophotographic photoconductor includes, from the innermost side thereof, a conductive support 31, an undercoat layer 32, a charge generation layer 35, and a charge transport layer 37. The charge generation layer 35 and the charge transport layer 37 correspond to the photosensitive layer.

Third Embodiment

Figure 3:
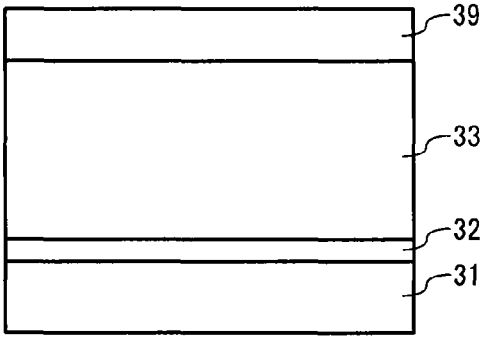
FIG. 3 is a schematic cross-sectional view of an electrophotographic photoconductor according to another embodiment of the present invention.

FIG. 3 is a schematic cross-sectional view of an electrophotographic photoconductor according to another embodiment of the present invention. The electrophotographic photoconductor illustrated in FIG. 3 has a single-layer photosensitive layer. This electrophotographic photoconductor includes, from the innermost side thereof, a conductive support 31, an undercoat layer 32, a single-layer photosensitive layer 33, and a protective layer 39.

Fourth Embodiment

Figure 4:
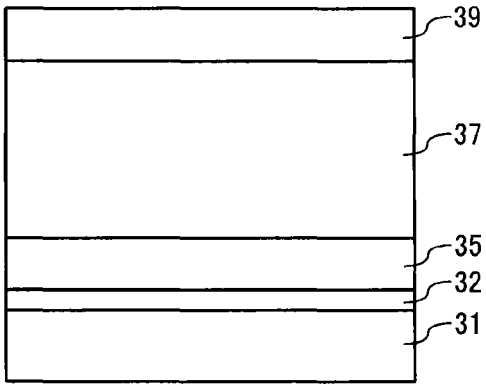
FIG. 4 is a schematic cross-sectional view of an electrophotographic photoconductor according to another embodiment of the present invention.

FIG. 4 is a schematic cross-sectional view of an electrophotographic photoconductor according to another embodiment of the present invention. The electrophotographic photoconductor illustrated in FIG. 4 has a multi-layer photosensitive layer. This electrophotographic photoconductor includes, from the innermost side thereof, a conductive support 31, an undercoat layer 32, a charge generation layer 35, and a charge transport layer 37, and a protective layer 39. The charge generation layer 35 and the charge transport layer 37 correspond to the photosensitive layer.

Image Forming Apparatus

An image forming apparatus in accordance with some embodiments of the present invention includes at least the above-described electrophotographic photoconductor in accordance with some embodiments of the present invention, a charger to charge a surface of the photoconductor, an irradiator to irradiate the charged surface of the photoconductor with light to form an electrostatic latent image thereon, a developing device to develop the electrostatic latent image with a developer including a toner to form a toner image on the surface of the photoconductor, and a transferring device to transfer the toner image to a recording medium, and optionally other devices, if necessary. The charger and irradiator may be hereinafter collectively referred to as an electrostatic latent image forming device.

Image Forming Apparatus Embodiment

Figure 5:
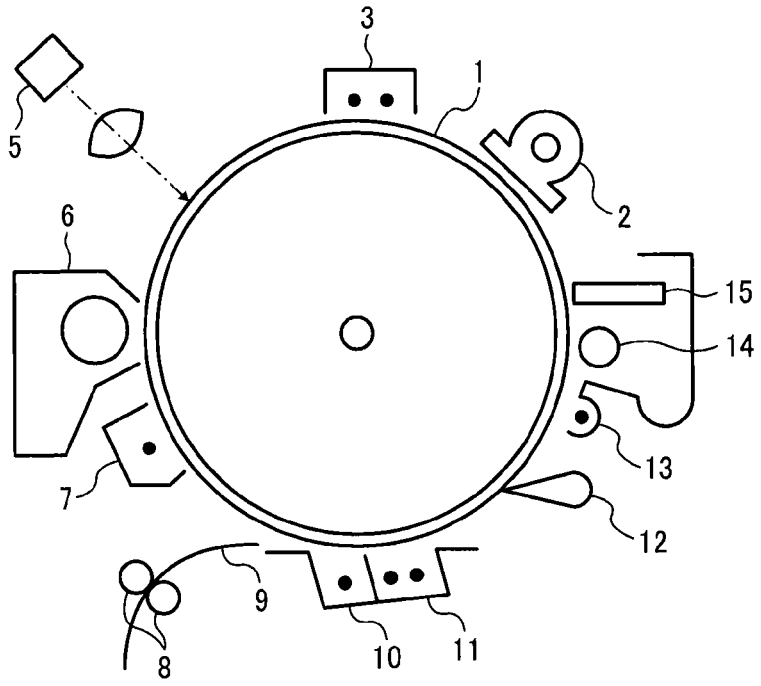
FIG. 5 is a schematic view of an image forming apparatus according an embodiment of the present invention.

FIG. 5 is a schematic view of an image forming apparatus according an embodiment of the present invention. The image forming apparatus includes an electrophotographic photoconductor 1; and a charger 3, an irradiator 5, a developing device 6, and a transfer device 10 disposed around the electrophotographic photoconductor 1. First, the charger 3 uniformly charges the electrophotographic photoconductor 1. Specific examples of the charger 3 include, but are not limited to, a corotron device, a scorotron device, a solid-state discharging element, a needle electrode device, a roller charging device, and a conductive brush device. Next, the irradiator 5 forms an electrostatic latent image on the uniformly-charged electrophotographic photoconductor 1. Specific examples of light sources for use in the irradiator 5 include, but are not limited to, all luminous matters such as fluorescent lamp, tungsten lamp, halogen lamp, mercury lamp, sodium-vapor lamp, light-emitting diode (LED), laser diode (LD), and electroluminescence (EL). For the purpose of emitting light having a desired wavelength only, any type of filter can be used such as sharp cut filter, band pass filter, near infrared cut filter, dichroic filter, interference filter, and color-temperature conversion filter.

Next, the developing device 6 develops the electrostatic latent image formed on the electrophotographic photoconductor 1 into a toner image that is visible. Developing method may be either a dry developing method using a dry toner, such as one-component developing method and two-component developing method; or a wet developing method using a wet toner. When the electrophotographic photoconductor 1 is positively (or negatively) charged and irradiated with light containing image information, a positive (or negative) electrostatic latent image is formed thereon. When the positive (or negative) electrostatic latent image is developed with a negative-polarity (or positive-polarity) toner, a positive image is produced. By contrast, when the positive (or negative) electrostatic latent image is developed with a positive-polarity (or negative-polarity) toner, a negative image is produced. Next, the transfer device 10 transfers the toner image from the electrophotographic photoconductor 1 onto a recording medium 9. For the purpose of improving transfer efficiency, a pre-transfer charger 7 may be used. The transfer device 10 may employ an electrostatic transfer method that uses a transfer charger or a bias roller; a mechanical transfer method such as adhesive transfer method and pressure transfer method; or a magnetic transfer method.

As means for separating the recording medium 9 from the electrophotographic photoconductor 1, a separation charger 11 and a separation claw 12 may be used, if necessary. The separation may also be performed by means of electrostatic adsorption induction separation, side-end belt separation, leading-end grip conveyance, curvature separation, etc.

As the separation charger 11, the above-described charger can be used. For the purpose of removing residual toner particles remaining on the electrophotographic photoconductor 1 without being transferred, cleaners such as a fur brush 14 and a cleaning blade 15 may be used. For the purpose of improving cleaning efficiency, a pre-cleaning charger 13 may be used. The cleaning may also be performed by a web-type cleaner, a magnetic-brush-type cleaner, etc. Such cleaners can be used alone or in combination. For the purpose of removing residual latent image on the electrophotographic photoconductor 1, a neutralizer 2 may be used. Specific examples of the neutralizer 2 include, but are not limited to, a neutralization lamp and a neutralization charger. As the neutralization lamp and the neutralization charger, the above-described light source and charger can be used, respectively. Processes which are performed not in the vicinity of the photoconductor, such as document reading, paper feeding, fixing, paper ejection, can be performed by known means.

Process Cartridge

Figure 6:
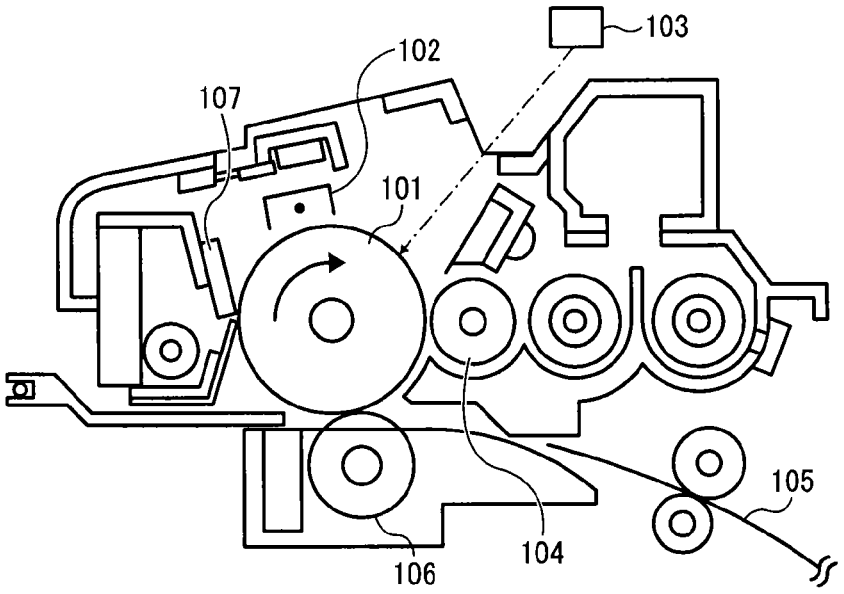
FIG. 6 is a schematic view of a process cartridge according to an embodiment of the present invention.
Figure 7:
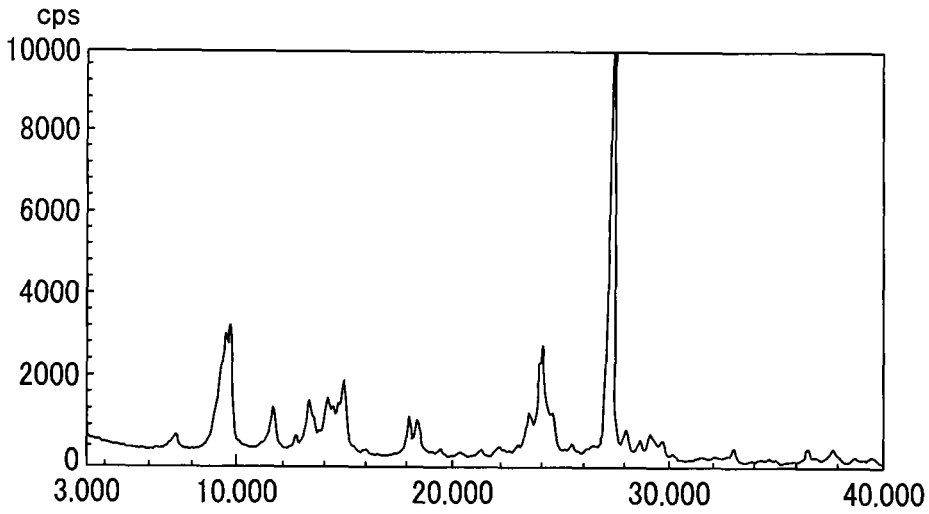
FIG. 7 is a powder X-ray diffraction spectrum of a titanyl phthalocyanine used in Examples, and the axis of ordinate expresses counts per second (cps) and the transverse axis expresses an angle (2θ).

A process cartridge in accordance with some embodiments of the present invention includes at least the above-described electrophotographic photoconductor according to an embodiment of the present invention; and at least one of a charger to charge a surface of the electrophotographic photoconductor, an irradiator to irradiate the charged surface of the electrophotographic photoconductor with light to form an electrostatic latent image thereon, a developing device to develop the electrostatic latent image into a visible image with toner, and a transfer device to transfer the visible image onto a recording medium. FIG. 6 is a schematic view of a process cartridge according to an embodiment of the present invention. This process cartridge includes an electrophotographic photoconductor 101, a charger 102, a developing device 104, a transfer device 106, a cleaner 107, and a neutralizer. The process cartridge is detachably mountable on image forming apparatus. In an image forming process, the photoconductor 101 rotates in a direction indicated by arrow in FIG. 6. A surface of the photoconductor 101 is charged by the charger 102 and irradiated with light emitted from an irradiator 103. Thus, an electrostatic latent image is formed on the surface of the photoconductor 101. The electrostatic latent image is developed into a toner image by the developing device 104. The toner image is transferred onto a recording medium 105 by the transfer device 106. The recording medium 105 having the toner image thereon is printed out. After the image transfer, the surface of the photoconductor 101 is cleaned by the cleaner 107 and neutralized by the neutralizer. These operations are repeatedly performed.

EXAMPLES

Having generally described this invention, further understanding can be obtained by reference to certain specific examples which are provided herein for the purpose of illustration only and are not intended to be limiting. In the descriptions in the following examples, "part(s)" described in Examples means "part(s) by mass.", unless otherwise specified.

Example 1

Preparation of Undercoat Layer Coating Liquid 1

The below-listed materials are stirred by a ball mill filled with zirconia beads having a diameter of 2 mm for 24 hours to prepare an undercoat layer coating liquid 1.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Metal oxide particle: Titanium oxide CR-EL (from ISHIHARA SANGYO KAISHA, LTD., Average primary particle diameter of 250 nm) | 80 parts |
| Compound having the urea group: Urea | 1 part |
| Solvent: 2-Butanone | 250 parts |

Preparation of Charge Generation Layer Coating Liquid

The below-listed materials are stirred by a bead mill filled glass beads having a diameter of 1 mm for 8 hours to prepare a charge generation layer coating liquid.

| | |
|---|---|
| Charge generation material: Titanyl phthalocyanine (A powder X-ray diffraction spectrum of the titanyl phthalocyanine is shown in FIG. | 8 parts |
| Binder resin: Polyvinyl butyral (S-LEC BX-1 from Sekisui Chemical Co., Ltd.) | 5 parts |
| Solvent: 2-Butanone | 400 parts |

Preparation of Charge Transport Layer Coating Liquid

The below-listed materials are mixed and stirred until all the materials are dissolved to prepare a charge transport layer coating liquid.

| | |
|---|---|
| Charge transport material having the formula (2) | 7 parts |

Formula (2)

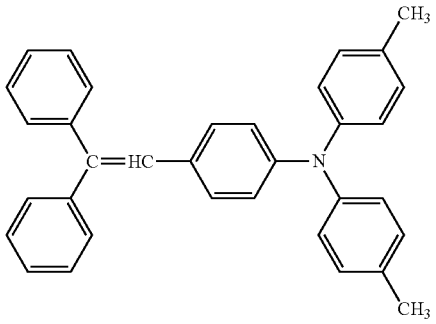

-continued

| | |
|---|---|
| Binder resin: Polycarbonate (TS-2050 from Teijin Chemicals Ltd.) | 10 parts |
| Leveling agent: Silicone oil (KF-50 from Shin-Etsu Chemical Co., Ltd.) | 0.0005 parts |
| Solvent: Tetrahydrofuran | 100 parts |

Preparation of Electrophotographic Photoconductor

The undercoat layer coating liquid is applied to an aluminum cylinder having a diameter of 100 mm and a length of 380 mm by a dipping method and dried at 130° C. for 30 minutes. Thus, an undercoat layer having an average thickness of 3.5 μm is formed. Next, the charge generation layer coating liquid is applied to the undercoat layer by a dipping method and dried at 90° C. for 30 minutes. Thus, a charge generation layer having an average thickness of 0.2 μm is formed. Next, the charge transport layer coating liquid is applied to the charge generation layer by a dipping method and dried at 130° C. for 30 minutes. Thus, a charge transport layer having an average thickness of 25 μm is formed. An electrophotographic photoconductor of Example 1 is prepared in the above manner.

Example 2

A photoconductor is manufactured in the same manner as in Example 1 except that the undercoat layer coating liquid 1 is changed to the undercoat layer coating liquid 2 as follows.

Preparation of Undercoat Layer Coating Liquid 2

The below-listed materials are stirred by a ball mill filled with zirconia beads having a diameter of 2 mm for 24 hours to prepare the undercoat layer coating liquid 2.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Metal oxide particle: Titanium oxide CR-EL (from ISHIHARA SANGYO KAISHA, LTD., Average primary particle diameter of 250 nm) | 80 parts |
| Compound having the urea group: 1-butyl urea | 1 part |
| Solvent: 2-Butanone | 250 parts |

Example 3

A photoconductor is manufactured in the same manner as in Example 1 except that the undercoat layer coating liquid 1 is changed to the undercoat layer coating liquid 3 as follows.

Preparation of Undercoat Layer Coating Liquid 3

The below-listed materials are stirred by a ball vibration mill filled with zirconia beads having a diameter of 2 mm for 24 hours to prepare an undercoat layer coating liquid 3.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |

-continued

| | |
|---|---|
| Metal oxide particle: Titanium oxide CR-EL (from ISHIHARA SANGYO KAISHA, LTD., Average primary particle diameter of 250 nm) | 80 parts |
| Compound having the urea group: p-tolyl urea | 1 part |
| Solvent: 2-Butanone | 250 parts |

Example 4

A photoconductor is manufactured in the same manner as in Example 1 except that the average thickness of the undercoat layer is changed from 3.5 μm to 20 μm, the heating drying temperature of the undercoat layer is changed from 130° C. to 150° C., and the undercoat layer coating liquid 1 is changed to the undercoat layer coating liquid 4 as follows.

Preparation of Undercoat Layer Coating Liquid 4

The below-listed materials are stirred by a ball mill filled with zirconia beads having a diameter of 2 mm for 24 hours to prepare the undercoat layer coating liquid 4

| Binder resins | |
|---|---|
| Butyral resin (BM-1 from Sekisui Chemical Co., Ltd.) | 10 parts |
| Blocked isocyanate (SUMIDUR BL 3175 from Sumika Bayer Co., Ltd.) | 13.3 parts |
| Metal oxide particle: Zinc oxide MZ-500 (from TAYCA CORPORATION, Average primary particle diameter of 25 nm) | 80 parts |
| Compound having the urea group: Benzyl urea | 1 part |
| Solvent: 2-Butanone | 250 parts |

Example 5

A photoconductor is manufactured in the same manner as in Example 4 except that the undercoat layer coating liquid 4 is changed to the undercoat layer coating liquid 5 as follows.

Preparation of Undercoat Layer Coating Liquid 5

The below-listed materials are stirred by a ball mill filled with zirconia beads having a diameter of 2 mm for 24 hours to prepare the undercoat layer coating liquid 5

| Binder resins | |
|---|---|
| Butyral resin (BM-1 from Sekisui Chemical Co., Ltd.) | 10 parts |
| Blocked isocyanate (SUMIDUR BL 3175 from Sumika Bayer Co., Ltd.) | 13.3 parts |
| Metal oxide particle: Zinc oxide MZ-300 (from TAYCA CORPORATION, Average primary particle diameter of 35 nm) | 80 parts |
| Compound having the urea group: Benzyl urea | 1 part |
| Solvent: 2-Butanone | 250 parts |

Example 6

A photoconductor is manufactured in the same manner as in Example 1 except that the average thickness of the undercoat layer is changed from 3.5 μm to 5 μm, and the undercoat layer coating liquid 1 is changed to the undercoat layer coating liquid 6 as follows.

Preparation of Surface-Treated Metal Oxide Particle a with Compound Having the Urea Group The below-listed materials are stirred for 2 hours. The mixture is subjected to distillation under reduced pressures to remove toluene, and then burned at 120° C. for 3 hours. Thus, surface-treated metal oxide particle A with the compound having the urea group are prepared.

| | |
|---|---|
| Metal oxide particle: Titanium oxide CR-EL (from ISHIHARA SANGYO KAISHA, LTD., Average primary particle diameter of 250 nm) | 80 parts |
| Compound having the urea group: 1-[3-(trimethoxysyril) propyl] urea | 1 part |
| Solvent: Toluene | 400 parts |

Preparation of Undercoat Layer Coating Liquid 6

The below-listed materials are stirred by a ball mill filled with zirconia beads having a diameter of 2 mm for 24 hours to prepare the undercoat layer coating liquid 6.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Surface-treated metal oxide particle A with the compound having the urea group | 80 parts |
| Solvent: 2-Butanone | 250 parts |

Example 7

A photoconductor is manufactured in the same manner as in Example 1 except that the undercoat layer coating liquid 1 is changed to the undercoat layer coating liquid 7 as follows.

Preparation of Surface-Treated Metal Oxide Particle B with Compound Having the Urea Group The below-listed materials are stirred for 2 hours. The mixture is subjected to distillation under reduced pressures to remove toluene, and then burned at 120° C. for 3 hours. Thus, surface-treated metal oxide particle B with the compound having the urea group are prepared.

| | |
|---|---|
| Metal oxide particle: Titanium oxide CR-EL (from ISHIHARA SANGYO KAISHA, LTD., Average primary particle diameter of 250 nm) | 80 parts |
| Compound having the urea group: 1-[3-(triethoxysyril) propyl] urea | 1 part |
| Solvent: Toluene | 400 parts |

Preparation of Undercoat Layer Coating Liquid 7

The below-listed materials are stirred by a ball mill filled with zirconia beads having a diameter of 2 mm for 24 hours to prepare the undercoat layer coating liquid 7.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Surface-treated metal oxide particle B with the compound having the urea group | 80 parts |
| Solvent: 2-Butanone | 250 parts |

Example 8

A photoconductor is manufactured in the same manner as in Example 1 except that the undercoat layer coating liquid 1 is changed to the undercoat layer coating liquid 8 as follows.

Preparation of Surface-Treated Metal Oxide Particle C with Compound Having the Urea Group The below-listed materials are stirred for 2 hours. The mixture is subjected to distillation under reduced pressures to remove toluene, and then burned at 120° C. for 3 hours. Thus, surface-treated metal oxide particle C with the compound having the urea group are prepared.

| | |
|---|---|
| Metal oxide particle: Zinc oxide MZ-500 (from TAYCA CORPORATION, Average primary particle diameter of 25 nm) | 80 parts |
| Compound having the urea group: 1-[3-(trimethoxysyril) propyl] urea | 1 part |
| Solvent: Toluene | 400 parts |

Preparation of Undercoat Layer Coating Liquid 8

The below-listed materials are stirred by a ball mill filled with zirconia beads having a diameter of 2 mm for 24 hours to prepare the undercoat layer coating liquid 8.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Surface-treated metal oxide particle C with the compound having the urea group | 80 parts |
| Solvent: 2-Butanone | 250 parts |

Example 9

A photoconductor is manufactured in the same manner as in Example 1 except that the undercoat layer coating liquid 1 is changed to the undercoat layer coating liquid 9 as follows.

Preparation of Surface-Treated Metal Oxide Particle D with Compound Having the Urea Group The below-listed materials are stirred for 2 hours. The mixture is subjected to distillation under reduced pressures to remove toluene, and then burned at 120° C. for 3 hours. Thus, surface-treated metal oxide particle D with the compound having the urea group are prepared.

| | |
|---|---|
| Metal oxide particle: Zinc oxide MZ-300 (from TAYCA CORPORATION, Average primary particle diameter of 35 nm) | 80 parts |
| Compound having the urea group: 1-[3-(trimethoxysyril) propyl] urea | 1 part |
| Solvent: Toluene | 400 parts |

Preparation of Undercoat Layer Coating Liquid 9

The below-listed materials are stirred by a ball mill filled with zirconia beads having a diameter of 2 mm for 24 hours to prepare the undercoat layer coating liquid 9.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Surface-treated metal oxide particle D with the compound having the urea group | 80 parts |
| Solvent: 2-Butanone | 250 parts |

Example 10

A photoconductor is manufactured in the same manner as in Example 4 except that the average thickness of the undercoat layer is changed from 20 μm to 5 μm, and the undercoat layer coating liquid 4 is changed to the undercoat layer coating liquid 10 as follows.

Preparation of Undercoat Layer Coating Liquid 10

The below-listed materials are stirred by a ball mill filled with zirconia beads having a diameter of 2 mm for 24 hours to prepare the undercoat layer coating liquid 10

| Binder resins | |
|---|---|
| Butyral resin (BM-1 from Sekisui Chemical Co., Ltd.) | 10 parts |
| Blocked isocyanate (SUMIDUR BL 3175 from Sumika Bayer Co., Ltd.) | 13.3 parts |
| Surface-treated metal oxide particle D with the compound having the urea group | 80 parts |
| Solvent: 2-Butanone | 250 parts |

Example 11

A photoconductor is manufactured in the same manner as in Example 4 except that the average thickness of the undercoat layer is changed from 20 μm to 30 μm, and the undercoat layer coating liquid 4 is changed to the undercoat layer coating liquid 11 as follows.

Preparation of Undercoat Layer Coating Liquid 11

The below-listed materials are stirred by a ball mill filled with zirconia beads having a diameter of 2 mm for 24 hours to prepare the undercoat layer coating liquid 11

| Binder resins | |
|---|---|
| Butyral resin (BM-1 from Sekisui Chemical Co., Ltd.) | 10 parts |
| Blocked isocyanate (SUMIDUR BL 3175 from Sumika Bayer Co., Ltd.) | 13.3 parts |
| Surface-treated metal oxide particle D with the compound having the urea group | 80 parts |
| Solvent: 2-Butanone | 250 parts |

Comparative Example 1

A photoconductor is manufactured in the same manner as in Example 1 except that the undercoat layer coating liquid 1 is changed to the undercoat layer coating liquid 12 as follows.

Preparation of Undercoat Layer Coating Liquid 12

The below-listed materials are stirred by a ball mill filled with zirconia beads having a diameter of 2 mm for 24 hours to prepare an undercoat layer coating liquid 12.

| Binder resins | |
|---|---|
| An alkyd resin BECKOSOL 1307-60-EL (from DIC Corporation) | 12 parts |
| Melamine resin SUPER BECKAMINE G-821-60 (from DIC Corporation) | 8 parts |
| Metal oxide particle: Titanium oxide CR-EL (from ISHIHARA SANGYO KAISHA, LTD., Average primary particle diameter of 250 nm) | 80 parts |
| Solvent: 2-Butanone | 250 parts |

Comparative Example 2

A photoconductor is manufactured in the same manner as in Example 11 except that the undercoat layer coating liquid 11 is changed to the undercoat layer coating liquid 13 as follows.

Preparation of Undercoat Layer Coating Liquid 13

The below-listed materials are stirred by a ball mill filled with zirconia beads having a diameter of 2 mm for 24 hours to prepare the undercoat layer coating liquid 13

| Binder resins | |
|---|---|
| Butyral resin (BM-1 from Sekisui Chemical Co., Ltd.) | 10 parts |
| Blocked isocyanate (SUMIDUR BL 3175 from Sumika Bayer Co., Ltd.) | 13.3 parts |
| Metal oxide particle: Zinc oxide MZ-300 (from TAYCA CORPORATION, Average primary particle diameter of 35 nm) | 80 parts |
| Solvent: 2-Butanone | 250 parts |

Photoconductor Characteristic

Image Forming Apparatus Used for Evaluations

A modified digital copier (RICOH Pro C900 from Ricoh Co., Ltd.) is used as an evaluation apparatus. The charger employs a scorotron charger (equipped with a discharge wire having a diameter of 50 μm made of gold-plated tungsten-molybdenum alloy). The light source for irradiating light containing image information employs LD light having a wavelength of 780 nm (images are written by polygon mirror and the resolution is 1,200 dpi). The developing device employs a two-component developing method using black toner. The transfer device employs a transfer belt. The neutralizer employs a neutralization lamp.

Deterioration of Photoconductor

To cause each electrophotographic photoconductor to deteriorate, a black single-color test chart (having an image area ratio of 5%) are continuously output on 20,000 sheets under a normal-temperature and normal-humidity condition of 23° C., 55% RH.

Electrical Characteristic Evaluation (Charge Property, Residual Potential, and Exposure Part Potential Variation)

Each photoconductor is subjected to a measurement of surface potential before and after the above deterioration procedure. Surface potential is measured with the evaluation apparatus, on which a potential sensor obtained by modifying the developing unit of the evaluation apparatus is mounted, in the following manner. While setting the amount of current applied to the discharge wire to −1,800 μA and the grid voltage to −800 V, a solid image is continuously formed on 100 sheets of A3-size paper in a longitudinal direction. The first sheet and the 100th sheet are subjected to a measurement of charged potential (VD) and post-irradiation potential (VL). The charged potential (VD) and post-irradiation potential (VL) are measured with a surface potentiometer (MODEL 344 from TREK Japan KK). Surface potential values are recorded by an oscilloscope at 100 signal/sec or more. The charge property and exposure part potential variation are evaluated based on the following criteria.

Evaluation Criteria for Charging Characteristics

AA: The difference in charged potential (ΔVD) before and after the deterioration of photoconductor at the 100th sheet is less than 10 V.

B: The difference in charged potential (ΔVD) before and after the deterioration of photoconductor at the 100th sheet is not less than 10 V and less than 20 V.

C: The difference in charged potential (ΔVD) before and after the deterioration of photoconductor at the 100th sheet is not less than 20 V.

Evaluation Criteria for Exposure Part Potential Variation

AA: The difference in post-irradiation potential (ΔVL) of photoconductor between the first sheet and the 100th sheet is less than 10 V.

B: The difference in post-irradiation potential (ΔVL) of photoconductor between the first sheet and the 100th sheet is not less than 10 V and less than 30 V.

C: The difference in post-irradiation potential (ΔVL) of photoconductor between the first sheet and the 100th sheet is not less than 30 V.

Image Evaluation

Images are output before and after the deterioration of photoconductor and subjected to evaluations in terms of residual image and background fog. Whether residual image is generated or not is determined by continuously outputting an x-shaped pattern with a size of 3 cm×3 cm on 3 sheets, then continuously outputting a halftone image on 3 sheets, and visually observing the images. Whether background fog is generated or not is determined by continuously outputting white solid image on 5 sheets or gloss-coated paper, and visually observing the images.

TABLE 1

| | | Exposure Part Potential Variation | | Image Evaluation | | | |
|---|---|---|---|---|---|---|---|
| | Charge Property ΔVD | Before the deterioration ΔVL | After the deterioration ΔVL | Before the deterioration residual image | After the deterioration residual image | Before the deterioration background fog | After the deterioration background fog |
| Example 1 | B | B | B | non-occurrence | slight residual image | excellent | excellent |
| Example 2 | B | B | B | non-occurrence | slight residual image | excellent | excellent |
| Example 3 | B | B | B | non-occurrence | slight residual image | excellent | excellent |

TABLE 1-continued

| | Charge Property ΔVD | Exposure Part Potential Variation: Before the deterioration ΔVL | Exposure Part Potential Variation: After the deterioration ΔVL | Image Evaluation: Before the deterioration residual image | Image Evaluation: After the deterioration residual image | Image Evaluation: Before the deterioration background fog | Image Evaluation: After the deterioration background fog |
|---|---|---|---|---|---|---|---|
| Example 4 | AA | AA | B | non-occurrence | slight residual image | extremely excellent | extremely excellent |
| Example 5 | AA | AA | B | non-occurrence | slight residual image | extremely excellent | extremely excellent |
| Example 6 | AA | B | B | non-occurrence | non-occurrence | extremely excellent | excellent |
| Example 7 | AA | B | B | non-occurrence | non-occurrence | extremely excellent | excellent |
| Example 8 | AA | AA | AA | non-occurrence | non-occurrence | extremely excellent | excellent |
| Example 9 | AA | AA | AA | non-occurrence | non-occurrence | extremely excellent | excellent |
| Example 10 | AA | AA | AA | non-occurrence | non-occurrence | extremely excellent | extremely excellent |
| Example 11 | AA | AA | AA | non-occurrence | non-occurrence | extremely excellent | extremely excellent |
| Comparative Example 1 | B | B | C | slight residual image | conspicuous residual image | slight background fog | conspicuous background fog |
| Comparative Example 2 | AA | B | B | slight residual image | conspicuous residual image | excellent | slight background fog |

What is claimed is:

1. A electrophotographic photoconductor, comprising:

a conductive support;

an undercoat layer overlying the conductive support;

and a photosensitive layer overlying the undercoat layer, wherein the undercoat layer comprises a metal oxide particle, a binder resin, and a compound having a urea group, wherein the compound having the urea group does not include urea resins.

2. The electrophotographic photoconductor according to claim 1, wherein the compound having a urea group is a compound of Formula (1)

Formula (1)

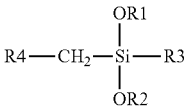

wherein R1 and R2 independently represent alkyl group having 1 to 2 carbon atoms, R3 represent alkyl group having 1 to 3 carbon atoms or alkoxy group having 1 to 2 carbon atoms, R4 represent structural formula having the urea group.

3. The electrophotographic photoconductor according to claim 1, wherein the metal oxide particle are zinc oxide particles.

4. The electrophotographic photoconductor according to claim 1, wherein an average thickness of the undercoat layer is from 3.5 μm to 30 μm.

5. The electrophotographic photoconductor according to claim 1, wherein the content of the metal oxide particle in the undercoat layer is of from 10% by mass to 80% by mass.

6. The electrophotographic photoconductor according to claim 1, wherein the compound having the urea group is at least one selected from among urea, 1-methyl urea, 1-ethyl urea, 1-propyl urea, 1-butyl urea, 1-pentyl urea, 1-hexyl urea, 1,1-dimethyl urea, 1,1-diethyl urea, 1,3-dimethyl urea, 1,3-diethyl urea, tetramethyl urea, tetraethyl urea, tetrabutyl urea, phenyl urea, 1,3-phenyl urea, o-tolyl urea, m-tolyl urea, p-tolyl urea, 1,3-diphenyl urea, 1,3-diethyl-1,3-diphenyl urea, N,N'-dimethyl-N, N'-diphenyl urea and benzyl urea.

7. The electrophotographic photoconductor according to claim 1, wherein a surface of the metal oxide particle is modified with the compound having the urea group.

8. The electrophotographic photoconductor according to claim 1, wherein the metal oxide particle is titanium oxide and the compound having the urea group is at least one selected from among urea, 1-butyl urea, p-tolyl urea, 1-[3-(trimethoxysyril) propyl] urea and 1-[3-(triethoxysyril) propyl] urea.

9. The electrophotographic photoconductor according to claim 1, wherein the metal oxide particle is zinc oxide and the compound having the urea group is at least one selected from among 1,3-diethyl urea, benzyl urea and 1-[3-(trimethoxysyril) propyl] urea.

10. An image forming apparatus, comprising:

the electrophotographic photoconductor according to claim 1;

a charger to charge a surface of the electrophotographic photoconductor;

an irradiator to irradiate the charged surface of the electrophotographic photoconductor with light to form an electrostatic latent image thereon;

a developing device to develop the electrostatic latent image into a visible image with toner;

and a transfer device to transfer the visible image onto a recording medium.

11. The image forming apparatus according to claim 10, wherein the charger is a scorotron charger.

12. The image forming apparatus according to claim 10, wherein a light source for use in the irradiator is laser diode light having a wavelength of 780 nm.

13. A process cartridge detachably mountable on image forming apparatus, comprising:

the electrophotographic photoconductor according to claim 1;

and at least one of a charger to charge a surface of the electrophotographic photoconductor, an irradiator to irradiate the charged surface of the electrophotographic photoconductor with light to form an electrostatic latent image thereon, a developing device to develop the electrostatic latent image into a visible image with toner, and a transfer device to transfer the visible image onto a recording medium.

14. The electrophotographic photoconductor according to claim 1, wherein the compound having the urea group to be selected from urea, 1-methyl urea, 1-ethyl urea, 1-propyl urea, 1-butyl urea, 1-pentyl urea, 1-hexyl urea, 1,1-dimethyl urea, 1,1-diethyl urea, 1,3-dimethyl urea, 1,3-diethyl urea, tetramethyl urea, tetraethyl urea, tetrabutyl urea, phenyl urea, 1,3-phenyl urea, o-tolyl urea, m-tolyl urea, p-tolyl urea, 1,3-diphenyl urea, 1,3-diethyl-1,3-diphenyl urea, N,N'-dimethyl-N,N'-diphenyl urea, benzyl urea, 1-[3-(trimethoxysilyl)propyl]urea, 1-[3-(triethoxysilyl)propyl]urea, 1[3-(dimethoxysilyl methyl)propyl]urea and 1-[3-(dimethoxysilyl propyl)propyl]urea.

* * * * *